United States Patent [19]

Bateman, Jr. et al.

[11] Patent Number: 4,574,218

[45] Date of Patent: Mar. 4, 1986

[54] METAL VAPOR LAMP HAVING INTERNAL MEANS PROMOTING CONDENSATE FILM FORMATION

[75] Inventors: Robert L. Bateman, Jr., Chagrin Falls; Thomas F. Soules, Cleveland Hts., both of Ohio

[73] Assignee: General Electric Company, Schenectady, N.Y.

[21] Appl. No.: 105,588

[22] Filed: Dec. 20, 1979

[51] Int. Cl.[4] ..... H01J 61/35

[52] U.S. Cl. ..... 313/635; 313/636

[58] Field of Search ..... 313/220, 221, 635, 636

[56] References Cited

U.S. PATENT DOCUMENTS

| | | | |
|---|---|---|---|
| 2,568,459 | 9/1951 | Noel | 313/220 |
| 3,153,169 | 10/1964 | Bauer | 315/108 X |
| 3,350,598 | 10/1967 | Corbin et al. | 313/220 |
| 3,379,302 | 4/1968 | Burggraaf et al. | 313/220 X |
| 3,488,540 | 1/1970 | Villain et al. | 313/220 X |
| 3,619,682 | 11/1971 | Lo et al. | 313/22 |
| 4,047,067 | 9/1977 | Clausen | 313/221 |
| 4,161,672 | 7/1979 | Cap et al. | 313/220 |

FOREIGN PATENT DOCUMENTS

| | | | |
|---|---|---|---|
| 26783 | 3/1976 | Japan | 313/221 |
| 113980 | 9/1979 | Japan | 313/221 |

OTHER PUBLICATIONS

"Electric Discharge Lamps," by John F. Waymouth, MIT Press 1971, pp. 231–234–The Effects of Arc Tube Geometry.

*Primary Examiner*—Palmer C. DeMeo

*Attorney, Agent, or Firm*—N. D. Herkamp; Philip L. Schlamp; Fred Jacob

[57] ABSTRACT

In a high intensity metal halide discharge lamp, means are provided associated with the interior surface of the envelope to promote the formation and spreading of a liquid film of condensate thereon. Such a film can lower the color temperature as a result of pressure broadening and self-reversal of the sodium line, and also by acting as a color correcting filter. The film-promoting means may be a coating which imparts an irregularity to the surface such that the reduction in exposed surface area by coverage with a uniform liquid film is energetically favored. Alternatively, a chemically different surface better wetted by the metal halide dose may be used.

6 Claims, 6 Drawing Figures

Fig. 1
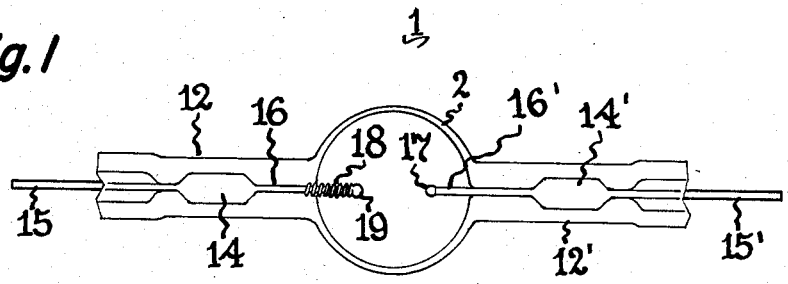
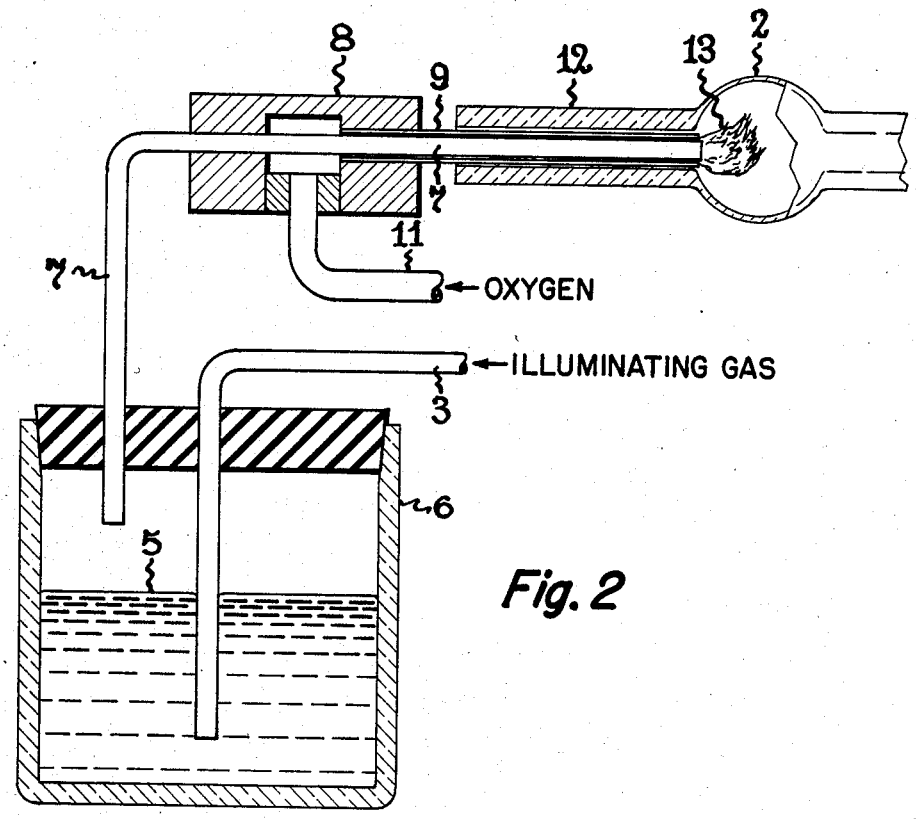
Fig. 2

METAL VAPOR LAMP HAVING INTERNAL MEANS PROMOTING CONDENSATE FILM FORMATION

The invention relates to high intensity metal vapor discharge lamps which operate with an unvaporized excess of metal and more particularly to metal halide lamps containing an excess of metal halide in liquid form.

BACKGROUND OF THE INVENTION

Metal halide lamps began with the addition of the halides of various light-emitting metals to the high pressure mercury lamp in order to modify its color and raise its operating efficacy as proposed by U.S. Pat. No. 3,234,421—Reiling, issued in 1966. Since then metal halide lamps have become commercially useful for general illumination; their construction and mode of operation are described in IES Lighting Handbook, 5th Edition, 1972, published by the Illuminating Engineering Society, pages 8–34.

The metal halide lamp generally operates with a substantially fully vaporized charge of mercury and an unvaporized excess consisting mostly of metal iodides in liquid form. The favored filling comprises the iodides of sodium, scandium and thorium. The operating conditions together with the geometrical design of the lamp envelope must provide sufficiently high temperatures, particularly in the ends, to vaporize a substantial quantity of the iodides, especially of the NaI. In general, this requires minimum temperatures under operating conditions of the order of 700° C.

The quantity of NaI which may be accommodated in the vapor state within a given volume at a given temperature, for instance at 750° C., can be readily calculated. However, the charge of NaI that is put into most lamps of commercial manufacture is many times greater, for instance 100 or more times, than such calculated quantity. Although most of the added NaI remains as condensate within the arc tube, the quantity participating in the arc discharge increases at a diminishing rate with the total quantity put into the tube. In Electric Discharge Lamps, MIT Press 1971, Chapter 8, Section 8.4, Effects of Arc Tube Geometry, John F. Waymouth speculates on this phenomenon and proposes, as explanation based on the non-isothermal nature of the bulb, that a film of condensate spreading beyond the point of minimum temperature towards higher temperatures would result in increasing the NaI pressure. He also offers an alternative explanation wherein the NaI pressure in the arc is viewed as being determined by a dynamic rather than an equilibratory process; convection currents bring gases that are much hotter than the wall past the surface of the condensate film, evaporating excess NaI to be carried through the arc before condensing elsewhere.

Irrespective of the explanation adopted, Waymouth concludes that it is desirable to have a condensate film as extensive as possible to get the maximum pressure of NaI in the gas for a given quantity of NaI added. In particular, he desires that the condensate be distributed over the barrel of the arc tube, spread as thinly as possible over as large an area as possible, and not condensed in the ends where there might be crevices or pockets that could store relatively large quantities with low surface area. To achieve this result, Waymouth wants the arc tube designed in such a way that the end temperatures are higher than those in the middle, so that excess iodide will condense in the middle of the arc tube.

We have observed that the condensate does not form a true film in the sense of a continuous layer on the inside of the quartz arc tube, but tends to remain as discrete droplets. We have found that the extent to which the area of the condensate can be increased by observing the Waymouth recommendations is quite limited. Also we have encountered other problems when much condensate coats the envelope walls about the middle of the arc tube, for instance as an equatorial band spaced away from both electrodes. The relatively large droplets of condensate in the band reduce transmission and may cause flickering as they form and move about. Another problem is the occurrence of flashes of reddish light, particularly during warm-up. These flashes appear to be due to rapid vaporization of drops of metal halide dose which form in the equatorial band and run down into the hotter end zone. Such problems are particularly acute in miniature metal halide arc tubes of one cubic centimeter or less such as disclosed in U.S. Pat. No. 4,161,672—Cap et al, July 1979.

SUMMARY OF THE INVENTION

The object of our invention is to achieve within a metal halide discharge lamp a film of condensate which is more extensive and continuous than possible up to now, and which preferably extends over substantially the entire inside surface of the discharge envelope. Such a film is useful to increase efficacy and improve color rendition by getting the maximum effective quantity of metal halide and particularly NaI in vapor form into the discharge. Another benefit from such a film is a filter effect which can be used to lower the color temperature of the emitted light.

In accordance with our invention, we provide means associated with the interior surface of the discharge envelope which promote the formation and spreading of a liquid film of condensate thereon. The formation of a continuous film is favored when its presence reduces the total surface energy. A film will tend to form when the surface energy in the wall to liquid dose interface, plus the surface energy in the liquid dose to vapor interface, is less than the surface energy in the wall to vapor interface. Letting:

$c$ = roughness factor of wall surface, $e_{w\text{-}d}$ = energy per unit area in wall to dose interface, $e_{d\text{-}v}$ = energy per unit area in dose to vapor interface, $e_{w\text{-}v}$ = energy per unit area in wall to vapor interface, the required relationship may be expressed algebrically by:

$$c \cdot e_{w\text{-}d} + e_{d\text{-}v} < c \cdot e_{w\text{-}v}$$

The film-promoting means associated with the interior surface may be a finish or a coating which imparts a roughness or irregularity to the surface such that the reduction in exposed surface area by coverage with a uniform liquid film is energetically favored. Alternatively the means may be a coating which provides a chemically different surface on the inside which is better wetted by the metal iodide dose. Or again a roughening coating which is also chemically favorable to film formation may be provided. The driving force desirably should be at least sufficient to cause the condensate liquid to flow at a rate which replenishes the loss from evaporation at any point on the surface, thus avoiding the occurrence of bare spots.

While the inside surface could be roughened by mechanical means such as sand blasting, we prefer to coat the inside surface of the envelope with a smoke of a refractory oxide, for instance a silica smoke. The smoked envelope is then torched from the outside to partially sinter the film into the wall and compact the smoke into a more rugged structure. The resulting surface causes the condensate to spread out by wick effect. We have found that the evenly dispersed dose or condensate lowers the color temperature as a result of pressure broadening and self-reversal of the sodium line, and also by acting as a color-correcting filter.

DESCRIPTION OF DRAWINGS

In the drawings:

FIG. 1 shows a miniature metal halide arc lamp embodying the invention.

FIG. 2 is a diagram of the process of smoking the interior of the arc tube.

DETAILED DESCRIPTION

Figure 5:
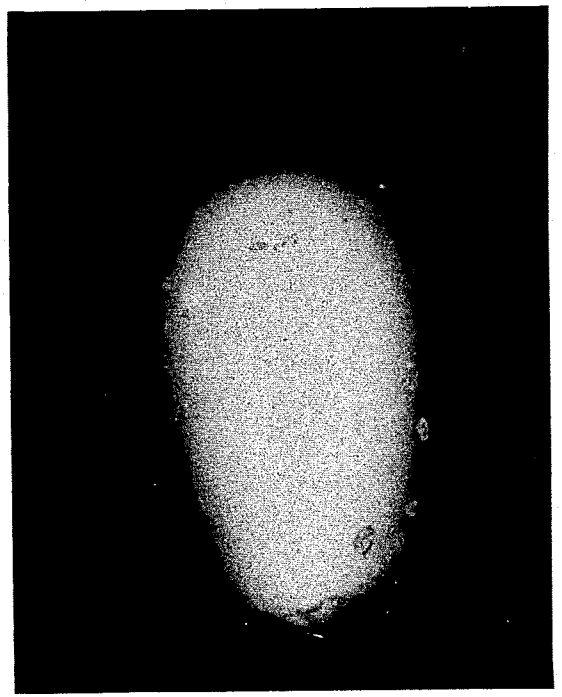
FIGS. 3 and 5 are enlarged photographs of miniature metal halide arc lamps under operating conditions, the former without and the latter with a film-promoting coating according to the invention.

A miniature arc tube 1 having an internal finish in the central bulb portion 2 causing the liquid condensate to spread into a film by capillary action in accordance with the invention is shown in FIG. 1. The bulb portion 2 may be formed by the expansion of quartz tubing in known manner and the inside is then coated with a smoke of a suitable metal oxide, for instance $SiO_2$. Silica smoke is conveniently produced by the combustion of chlorotrimethylsilane in a gas-oxygen flame. Referring to FIG. 2 illustrating a suitable setup for laboratory use, illuminating gas is supplied to tubing 3 and bubbled through liquid chlorotrimethylsilane 5 in stoppered beaker 6. The gas carries the chlorotrimethylsilane vapor out through tubing 7 extending through T-junction 8 and outer tube 9. Oxygen is supplied through branch tubing 11 to the T-junction and thence flows in the annular channel between outer tube 9 and internal duct 7. Outer tube 9 penetrates through neck 12 into the bulb portion 2 of the arc tube. The illuminating gas and chlorotrimethylsilane are ignited and burn in the oxygen producing a small flame 13. For the illustrated bulb, the gas flow is adjusted to have a flame about 2 to 3 millimeters in size. The products of combustion are water vapor and a white smoke of $SiO_2$ which coats the inside of the bulb; the bulb is rotated and moved to and fro axially during smoking to obtain an even coating.

After smoking, the bulb is immediately heated to drive out any water vapor which could damage the fragile smoke film. The smoked bulb is then torched from the outside to partially sinter the film into the wall of the bulb and compact the smoke into a more rugged structure. The bulb temperature during torching must be closely watched since too hot a flame will completely melt the smoke into the fused silica wall, while too cool a flame will not produce the required densification and attachment. The coated bulb is then processed into an arc tube in known manner.

An alumina coating has the additional advantage over a silica coating that it is more readily wetted by the metal halide dose. We have applied such a coating by alternate generation of silica and alumina smokes within the quartz bulb. The silica smoke was produced by focusing a laser beam on the tip of a silica rod inserted into the bulb through one neck. The laser beam was conveniently aimed through the other neck. Then the silica rod was replaced by an alumina rod and alumina smoke generated in the same way. By so doing, the alumina becomes firmly attached to the wall when subsequently sintered, the silica apparently serving as a binder. The alumina smoke all by itself when sintered forms a crusty layer that lacks adherence. The alumina coating changes the chemical nature of the surface in a direction to favor wetting and film formation when contacted by a metal halide such as sodium iodide.

In the completed lamp shown in FIG. 1, the seals are made by collapsing through heat-softening, assisted by vacuum if desired, the quartz of the necks 12,12' upon the molybdenum foil portions 14,14' of the electrode inlead assemblies. Leads 15,15' welded to the foils project externally of the necks while electrode shanks 16,16' welded to the opposite sides of the foils extend through the necks into the bulb portion. The lamp is intended for unidirectional current operation and the shank 16' terminated by a balled end 17 suffices for an anode. The cathode comprises a hollow tungsten helix 18 spudded on the end of shank 16 and terminating at its distal end in a mass or cap 19 which may be formed by melting back a few turns of the helix.

A typical metal halide arc tube intended for a lamp of 35 watt size may have a bulb outer diameter of about 0.7 cm and a discharge volume of 0.1 to 0.15 cubic centimeter. A suitable filling for the envelope comprises argon or other inert gas at a pressure of several tens of torr to serve as a starting gas, and a charge comprising mercury and the metal halides NaI, $ScI_3$ and $ThI_4$. The charge may be introduced into the arc chamber through one of the necks before sealing in the second electrode. The illustrated arc tube is usually mounted within an outer protective envelope or jacket (not shown) having a base to whose contact terminals the inleads 15,15' are connected.

The sintered smoke layer in bulb 2 causes a wick effect which succeeds in spreading out the liquid dose or condensate into a substantially continuous film.

Figure 3:
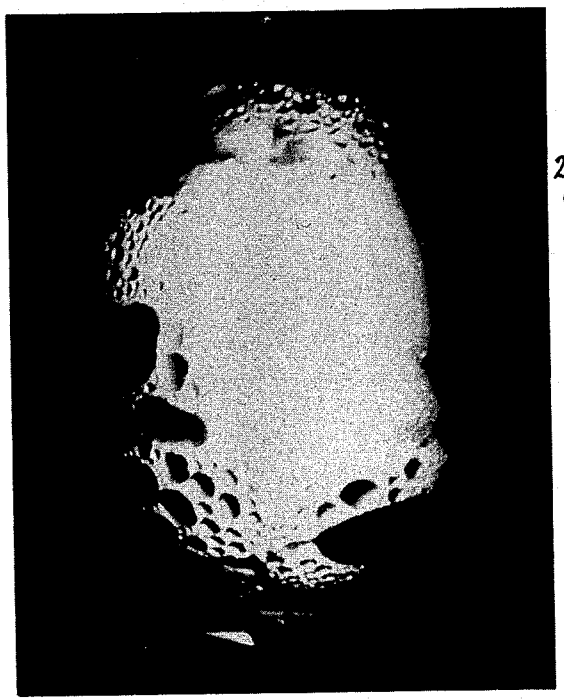

The effectiveness of the layer is readily apparent when FIG. 3 in which the bulb does not have a sintered smoke layer is compared with FIG. 5 in which a layer is present. Both figures are photographs of the images produced on a screen by focusing the light from operating lamps thereon through a converging lens.

Figure 4:
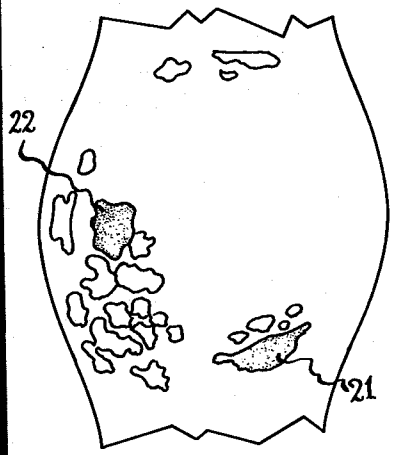
FIG. 4 is a sketch outlining the principal features in the photograph of FIG. 3.

In FIG. 3 where no layer is present, the condensate does not form a continuous film but discrete droplets which tend to persist. Some droplets become larger as more condensate joins the mass, for instance droplets 21 and 22 indicated in FIG. 4. Eventually the weight of a large droplet may cause it to roll down the wall into the end. Sudden vaporization of the droplet should it touch the hot shank of the electrode may produce a reddish flash, and movement of the droplets causes some flickering.

In FIG. 5 wherein a silica smoke layer embodying the invention has been provided, a continuous film of condensate is present covering substantially the entire interior surface of the bulb. The large droplets have been dispersed in the film. The film produces improved vaporization of the dose which results in the desired lower color temperature.

Figure 6:
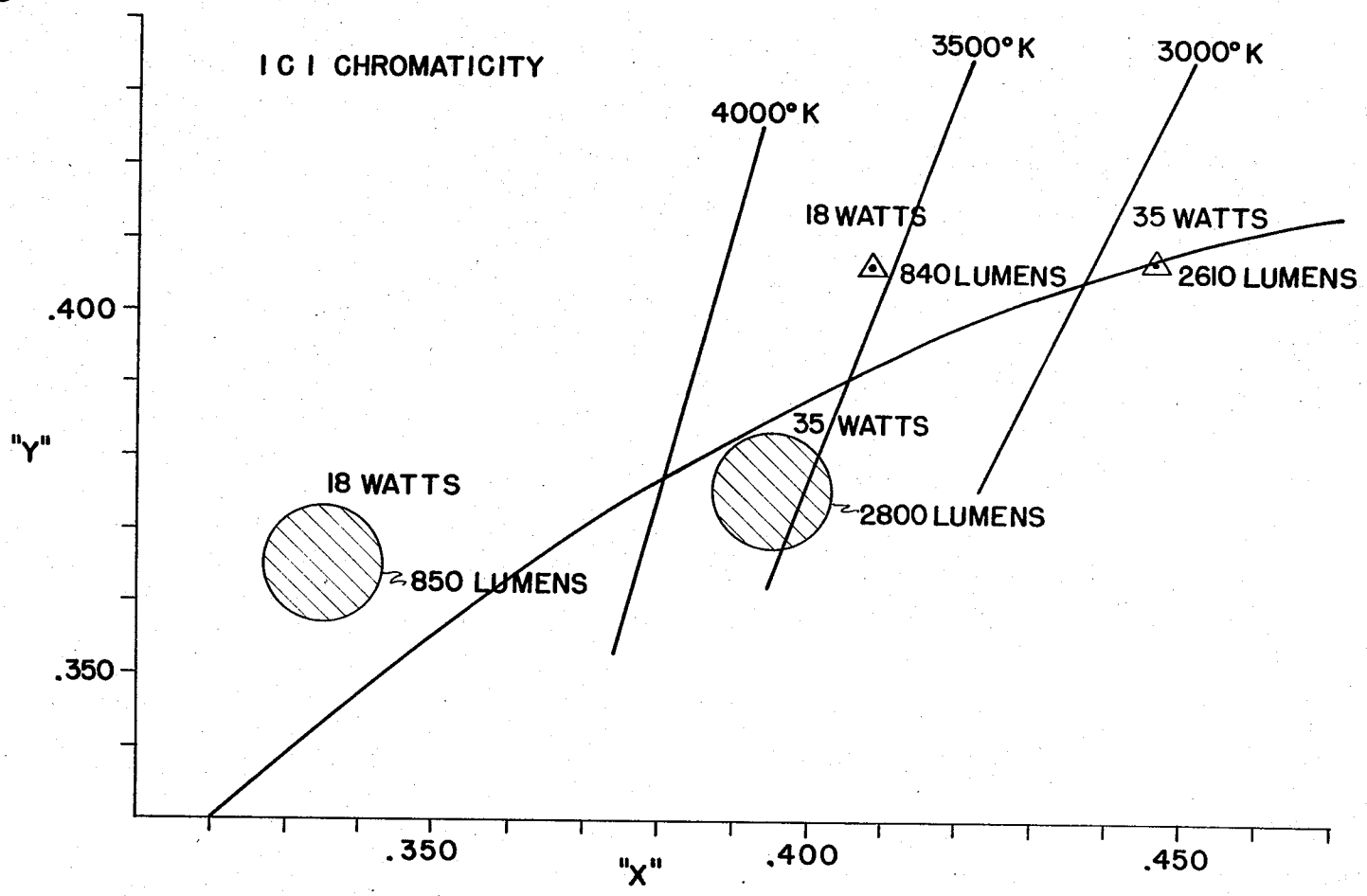
FIG. 6 is a chromaticity diagram comparing lamp performance with and without film-promoting coating.

In FIG. 6, the magnitude and direction of the shift in spectral output is indicated by means of ICI chromaticity coordinates. The two cross-hatched circles represent the mean or range of variation in spectral response at two power levels, 18 watts and 35 watts, for lamps of the kind shown in FIG. 1 but without any means promoting the formation of a liquid condensate film. The spectral response of a lamp provided with a sintered silica smoke coating is shown by the two dots-within-triangle, and the corresponding lumen outputs are also indicated. The solid curving line conventionally represents the black body locus, and the sloping lighter lines, the correlated loci of color temperatures of 4000° K., 3500° K. and 3000° K. The shift in spectral response to the right along the black body locus to a lower color temperature caused by the coating is particularly evident at low power. The color temperature tends to be too high at low power due to inadequate sodium iodide vapor pressure. The indicated shift to a lower color temperature is more pronounced at the lower level where it is most needed. The shift results from pressure broadening and self-reversal of the sodium emission, and also the film of evenly dispersed halide dose acts as a color correcting filter.

In lamps having the continuous film of liquid dose on the inside which our invention makes possible, flicker during start-up is completely eliminated. When power is turned off, the dispersed halide dose condenses and crystallizes over the entire interior surface of the bulb. When the lamp is subsequently turned on, melting and vaporization occur smoothly and evenly and the liquid condensate film is promptly reformed.

What we claim as new and desire to secure by Letters Patent of the United States is:

1. A high intensity metal vapor discharge lamp comprising:

a sealed envelope having light-transmitting walls;

a filling in said envelope producing a vapor in which an electric discharge generates light; said filling including a dose of metal salt substantially in excess of the quantity vaporized in operation of said lamp; said dose being liquid at the wall temperature in said envelope during operation;

electrode means for supporting a discharge within said envelope; and film-formation-promoting means comprising a coating of fine refractory oxide particles adherent to the interior surface of said envelope for promoting the formation and spreading of a liquid condensate film thereon.

2. A lamp as in claim 1 wherein the film-formation-promoting means is a coating produced by causing a smoke of refractory oxide particles to contact the interior surface of said envelope and form a film thereon, and by thereafter partially sintering the film to compact it into a more rugged structure and improve its adherence to the envelope.

3. A high intensity metal vapor discharge lamp comprising:

a sealed vitreous envelope;

a discharge-supporting filling in said envelope comprising mercury and metal halide; the quantity of metal halide being substantially in excess of that vaporized in operation of said lamp; said metal halide being liquid at the temperature of the interior of said envelope during operation;

electrode means for supporting a discharge within said envelope; and film-formation-promoting means comprising a coating of fine refractory oxide particles adherent to the interior surface of said envelope for promoting the formation and spreading of a liquid condensate film thereon.

4. A lamp as in claim 3 wherein the envelope is fused silica and the coating comprises silica particles.

5. A lamp as in claim 3 wherein the envelope is fused silica and the coating comprises alumina particles.

6. A lamp as in claim 3 wherein the envelope is fused silica and the coating is produced by causing a smoke of refractory oxide particles to contact the interior surface of said envelope and form a film thereon, and by thereafter partially sintering the film to compact it into a more rugged structure and improve its adherence to the envelope.

* * * * *